United States Patent [19]

Rich et al.

[11] B 3,983,719

[45] Oct. 5, 1976

[54] KNITTING NEEDLE

[75] Inventors: Hubert A. Rich, Westminster; James H. Fox, Torrance; John W. Ryan, Los Angeles, all of Calif.

[73] Assignee: Mattel, Inc., Hawthorne, Calif.

[22] Filed: Feb. 1, 1974

[21] Appl. No.: 438,882

[44] Published under the second Trial Voluntary Protest Program on February 24, 1976 as document No. B 438,882.

[52] U.S. Cl. ..... 66/116; 66/90; 66/13

[51] Int. Cl.[2] ..... D04B 35/02

[58] Field of Search ..... 66/116, 13, 62, 120, 66/90

[56] References Cited

UNITED STATES PATENTS

| | | | |
|---|---|---|---|
| 137,568 | 4/1973 | Platt et al. | 66/13 |
| 863,482 | 8/1907 | Young | 66/62 |
| 1,364,088 | 1/1921 | Fenn | 66/13 |
| 1,461,007 | 7/1923 | Taft | 66/120 |
| 2,560,872 | 7/1951 | Pares et al. | 66/104 |
| 3,828,582 | 8/1974 | Widdowson et al. | 66/13 |

FOREIGN PATENTS OR APPLICATIONS

| | | | |
|---|---|---|---|
| 294,652 | 2/1954 | Switzerland | 66/116 |

*Primary Examiner*—Mervin Stein
*Assistant Examiner*—A. M. Falik
*Attorney, Agent, or Firm*—Stephen L. King; Max E. Shirk; Robert W. Mulcahy

[57] ABSTRACT

As the knitting needle reciprocates between two stationary, upstanding fingers, a notch on the needle loads a loop of yarn onto the fingers and the nose of the needle passes down inside the loop during the down-portion of one stroke and moves up outside the loop to unload it from the fingers during the beginning of the up-portion of the next stroke.

3 Claims, 12 Drawing Figures

12
34
32
104
102
96
98
30
36
28
88
26
38
86
76
46
42
80
52
56
92
72
64
58
92
54
44
50
48
62
78
120
118
70
40
10
84
66
94
110
100
24
108
22
106
20
18
4
4
14
16

KNITTING NEEDLE

BACKGROUND OF THE INVENTION

The background of the invention will be set forth in two parts.

1. Field of the Invention

The present invention pertains generally to the field of knitting machines and more particularly to a knitting needle having knitted-loop loading and unloading capability.

2. Description of the Prior Art

The prior art known to applicants is listed by way of illustration, but not of limitation, in separate communications to the United States Patent Office. The present invention exemplifies improvements over this prior art.

More particularly, U.S. Pat. No. 2,560,872 discloses a knitting machine wherein a knitting needle reciprocates within a pair of fingers provided on a mesh-holding device. The needle includes a longitudinal groove in which a hook on a third finger or a loop unloader rides. The unloader also reciprocates at appropriate times so that the hook will engage the loop carried by the needle and hold the loop until the hooked portion of the needle passes through the loop. The unloader then moves to its original position releasing the loop onto the mesh-holding device.

It is apparant that the reciprocating unloader makes a knitting machine more complicated and expensive than it would be if it did not have such a moving part.

SUMMARY OF THE INVENTION

The needle of the present invention eliminates the need for a reciprocating unloader or other moving parts used for loading and unloading loops from a needle by providing means on the needle for loading and unloading knitted loops.

Accordingly, it is an object of the present invention to provide a knitting needle having knitted-loop loading and unloading capability inherent in the shape of the needle and cooperating fingers and requiring no moving part other than the needle.

According to the present invention, an improved knitting needle is provided in combination with a knitting machine having loop-holding means and means for imparting a predetermined stroke to a knitting needle.

The improved knitting needle includes a hook, first means adjacent the hook for carrying a knitted loop from the hook to the loop-holding means during a first increment of the predetermined stroke and second means adjacent the hook for casting the knitted loop off the loop-holding means during a second increment of the stroke.

The needle includes an elongated shank having a front side, a rear side, an upper end and a lower end. A hook is formed at the upper end and the hook includes an open side and a closed side. The closed side includes a pointed nose portion extending upwardly and outwardly away from the front side of the shank to a predetermined position.

The needle also includes an elongated web which is provided on the front side of the shank and which includes a ramp adjacent the open side of the hook. A loop-holding notch is provided on the web between the ramp and the lower end of the shank so that a knitted loop of yarn may leave the hook through the open side, move down the ramp and become engaged in the notch during upward movement of the needle. The predetermined position of the pointed nose portion is laterally outwardly beyond the shank so that it lies in approximately the same plane as the web so that the pointed nose portion will move to the outer perimeter of a knitted loop to dislodge it from the loop-holding device when the needle starts a new stroke from its lowermost position after completing a preceding stroke wherein the notch carried the knitted loop to the loop-holding device.

The needle also includes connecting means formed at the lower end for connecting the needle to a knitting machine for reciprocation thereby.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

Figure 1:
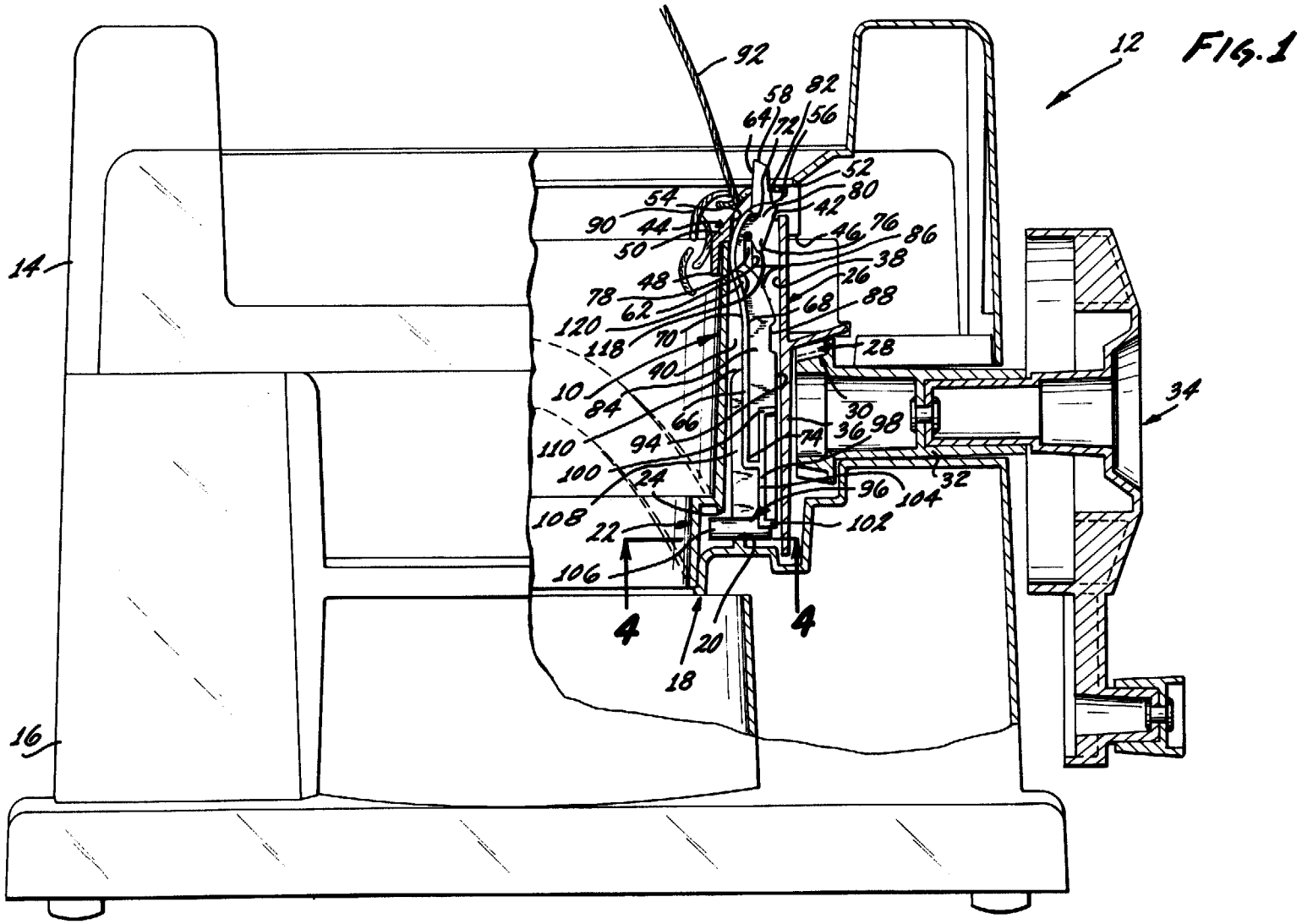
FIG. 1 is an elevational view, with parts broken away to show internal construction, of a knitting machine incorporating a knitting needle of the present invention.
Figure 2:
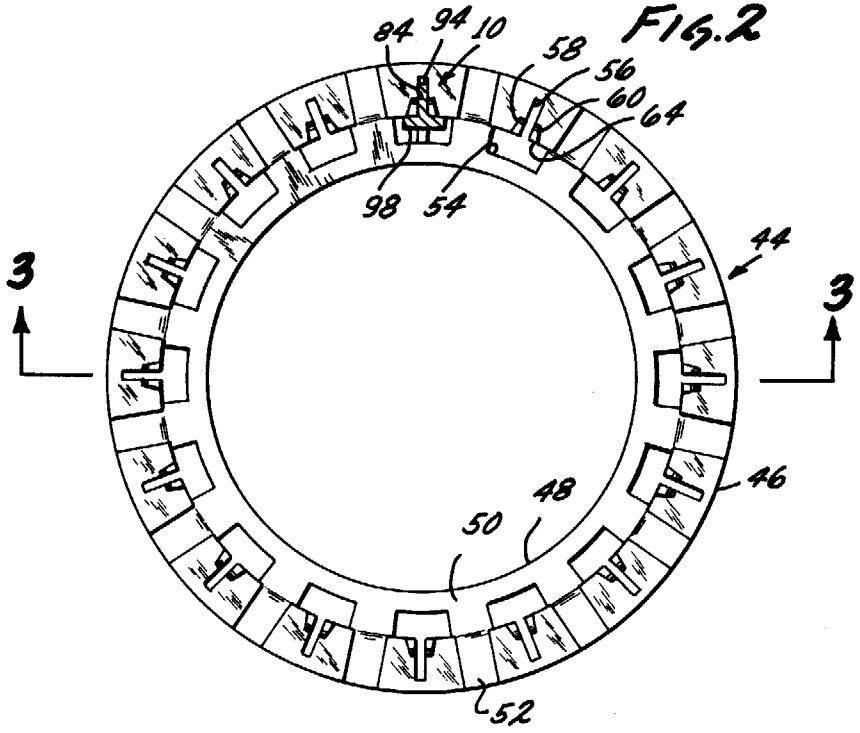
FIG. 2 is a plan view of a needle-drum cap shown on the machine in FIG. 1 and showing the relative position of the needle therein.

DESCRIPTION OF THE PREFERRED EMBODIMENT:

Referring again to the drawings, and more particularly to FIGS. 1–4, a knitting needle constituting a presently preferred embodiment of the invention, generally designated 10, is shown in combination with a knitting machine 12.

Knitting machine 12 may be of the tube-knitting or circular-knitting type and includes an upper housing 14 and a lower housing 16. Lower housing 16 is formed integrally with a first needle cam 18 having a cam face 20 adapted to move needle 10 on the up portion of its stroke, as indicated by the cam curve depicted in broken lines in FIG. 1 as extending upwardly and inwardly from cam face 20. A second needle cam 22 is fixedly mounted in lower housing 16 and includes a cam face 24 adapted to move needle 10 on the down portion of its stroke, as indicated by the cam curve depicted in broken lines in FIG. 1 as extending upwardly and inwardly from cam face 24.

Knitting machine 12 also includes a cylindrical needle drum 26 rotatably mounted in lower housing 16 in encompassing relationship with cams 18, 22 for carrying a plurality of needles 10 in a circular pattern during reciprocation thereof by cams 18, 22. Needle drum 26 may be injection molded from a suitable plastic, such as a polypropylene, and is formed integrally with a ring gear 28 which meshes with a pinion gear 30 journalled between housings 14, 16 by a shaft 32 adapted to be manually rotated by a crank assembly 34. Thus, manual actuation of crank assembly 34 imparts rotation to needle drum 26 through pinion 30 and ring gear 28. Needle drum 26 includes an encompassing side wall 36 (FIGS. 1 and 4) having an inner surface 38 carrying a plurality of vertical, uniformly-spaced needle guides 40 having a T-shaped cross-section.

Needle drum 26 also includes an open top 42 which is closed by a drum cap 44 (FIGS. 1, 2 and 3) having an outer, annular, depending lip 46 encompassing drum 26 at open top 42 and an inner, annular, depending lip 48 encompassing cam 22 at the upper, inner surface thereof. Lip 48 depends from an annular apron 50 sloping downwardly and inwardly from the upper surface 52 of cap 44 for supporting knitted yarn. Apron 50 is provided with an opening 54 for each needle 10. Openings 54 merge into openings 56 which are provided in the upper surface 52. As may be seen in FIG. 2, the openings 54, 56 form T-shaped openings for needle 10. A pair of upstanding fingers 58, 60 are provided on the upper surface 52 of cap 44 adjacent each of the openings 54, 56 for forming loop-holding means. The function of these loop-holding means will be described hereinafter. Drum cap 44 also includes a plurality of tabs 62 depending from apron 50 in the same plane as the inner surface 64 of fingers 58, 60 for serving as guides for needle 10. As is clear from FIG. 3, a pair of closely-spaced tabs 62 are provided for a single needle 10.

Referring again to FIGS. 1–4, needle 10 includes an elongated shank 66 having a front side 68, a rear side 70, an upper end 72 and a lower end 74. A hook 76 is formed at the upper end 72 and is provided with an open side 78 and a closed side 80. The closed side 80 includes a pointed nose portion 82 extending upwardly and outwardly away from the front side 68 of shank 66 to a predetermined position to be hereinafter defined.

Needle 10 also includes an elongated web 84 provided on the front side 68 of shank 66 and including a ramp 86 adjacent the open side 78 of hook 76. A loop-holding notch 88 is provided on web 84 between ramp 86 and the lower end 74 of shank 66 so that a knitted loop 90 of yarn 92 may leave hook 76 through open side 78, move down ramp 86 and become engaged in notch 88 during upward movement of needle 10. The predetermined position of pointed nose portion 82 is laterally outwardly beyond shank 66 to approximately the same plane as the leading edge 94 of web 84. This leading edge 94 and nose portion 82 ride in opening 56 on the outside of fingers 58, 60 so that nose portion 82 will be at the outer perimeter of loop 90 to dislodge loop 90 from fingers 58, 60 when needle 10 starts a new stroke from its lowermost position after completing a preceding stroke wherein notch 88 carried loop 90 to fingers 58, 60.

Figure 1A:
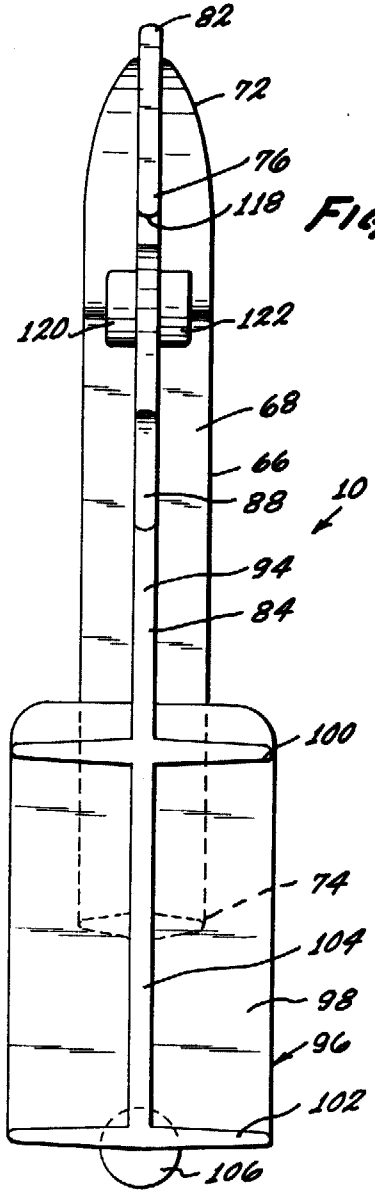
FIG. 1A is an enlarged, front elevation view of the knitting needle shown in the machine of FIG. 1.
Figure 3:
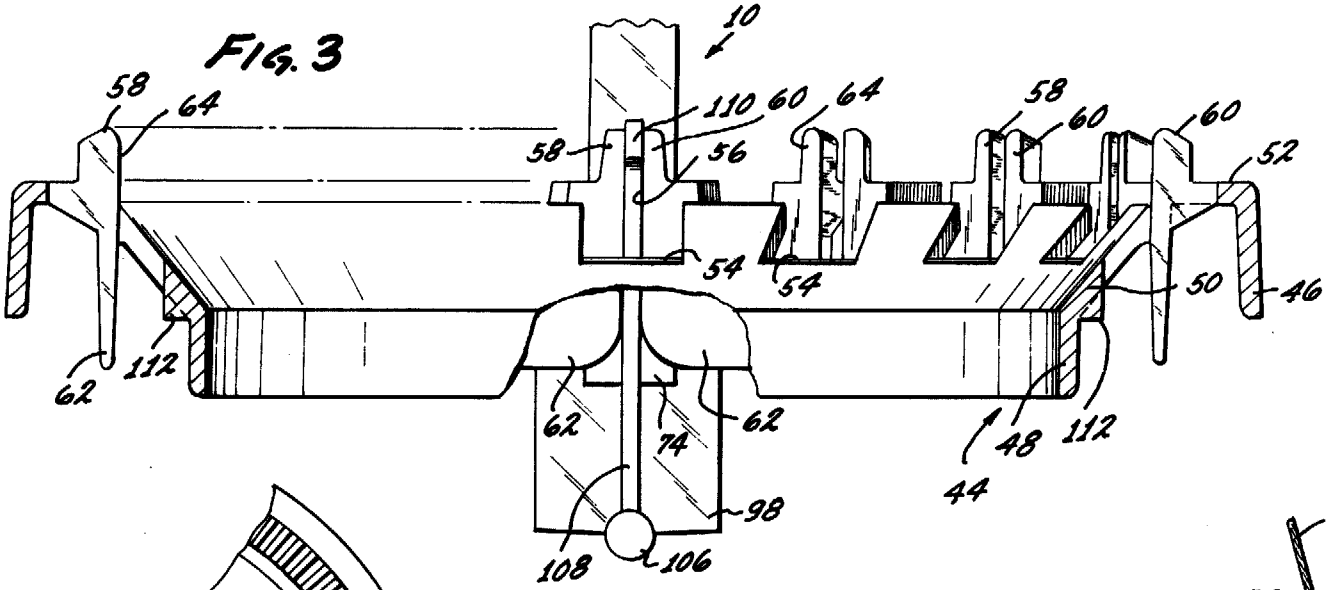
FIG. 3 is an enlarged, cross-sectional view taken along line 3—3 of FIG. 2.
Figure 4:
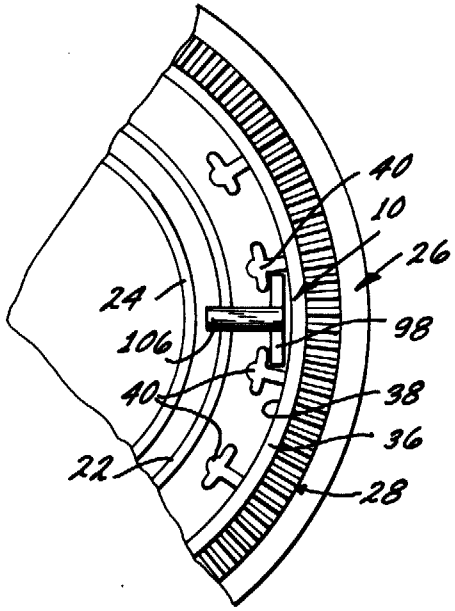
FIG. 4 is an enlarged, partial cross-sectional view taken along line 4—4 of FIG. 1.

Needle 10 is connected to knitting machine 12 by a connecting means 96 which may be formed at the lower end 74 of shank 66 during a molding operation from a suitable plastic material, such as an acetal resin. Connecting means 96 includes a plate 98 slidably mounted in a way formed by a pair of needle guides 40 on drum 26, as shown in FIG. 4. Plate 98 is reinforced by a pair of transverse ribs 100, 102 (FIG. 1A) and by a longitudinal rib 104, forming a continuation of web 84. Connecting means 96 also includes a cam follower 106 which rides on cam faces 20, 24. A second longitudinal rib 108 (FIG. 1) is provided on needle 10 on the rear side 70 of shank 66 and extends beyond the lower end 74 of shank 76 into engagement with cam follower 106. The ribs 100, 102, 104 and 108 also act as spacers filling the space between drum 26 and cam 22. Rib 108 also bears against apron 50 in opening 54 when needle 10 is in the upper portion of its stroke to maintain the substantially vertical attitude of shank 66 so that notch 88 will be positioned on the outside of fingers 58, 60 for depositing loop 90 thereon during the down portion of the needle stroke. Additionally, a ramp 110 (FIG. 1), which is provided at the upper end of rib 108, engages a slight protuberance 112 (FIG. 3), which is provided at the base of apron 50 adjacent the center of opening 54, during the up portion of each stroke of needle 10 so that the passing of the upper end of rib 108 from cam 22 to apron 50 will be smooth.

Hook 76 includes a tip or end portion 118 which lies in a vertical plane inwardly from the vertical plane passing through the leading edge 94 of web 84 so that tip 118 will pass inside of loop 90 during the down portion of a needle stroke without snagging loop 90. Needle 10 also includes a pair of semi-circular spacers 120, 122, which are provided on the front side 68 of shank 66 below hook 76. These spacers are adapted to ride on the inner surface 64 of fingers 58, 60 to help maintain the proper size of loop 90 and to prevent loop 90 from shifting tip 118 out of its path of travel. The size of loop 90 is also maintained by a suitable radius formed in hook 76 at its closed side 80.

Figure 5:
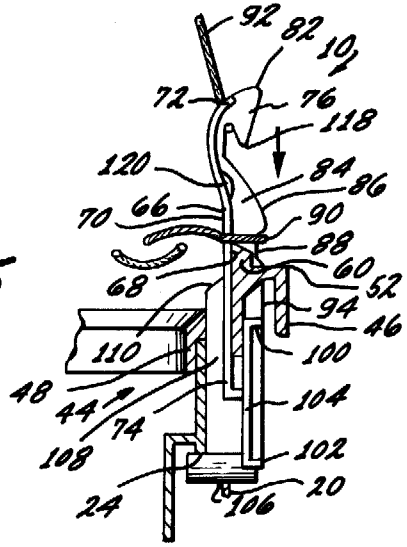
FIGS. 5–11 are schematic views showing the needle of FIG. 1 and its associated parts during different steps of a knitting operation.

Operation of needle 10 will be described in connection with FIGS. 5–11. It will be apparent to those skilled in the art and it will be evident from a study of FIGS. 5–11 that knitted loop 90 and yarn 92 are suitably tensioned during the operational steps hereinafter described. FIG. 5 shows needle 10 at the upper limit of the up portion of its stroke where it is ready to start the down portion of its stroke. In this position, hook 76 has just engaged a fresh increment of yarn 92 and loop 90 encompasses shank 66 and web 84 at notch 88 with sufficient tension to maintain loop 90 in notch 88 during the beginning of the down portion of the needle stroke.

Figure 6:
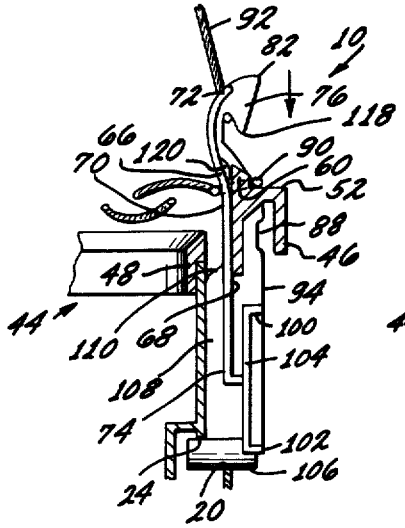

FIG. 6 shows needle 10 after it has moved downwardly sufficiently for notch 88 to pass between fingers 58, 60 depositing loop 90 thereon. Tension in the knitted fabric maintains loop 90 against fingers 58, 60 until loop 90 is removed therefrom by nose portion 82 of needle 10.

Figure 7:
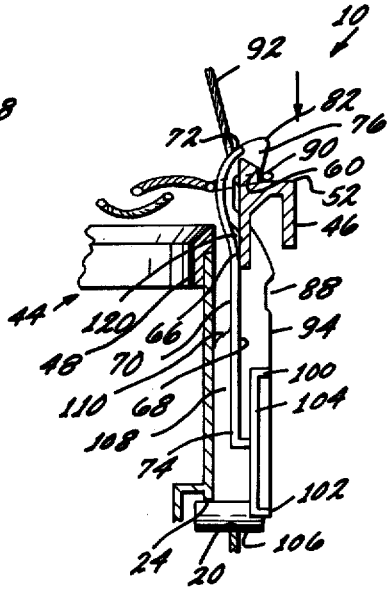
Figure 8:
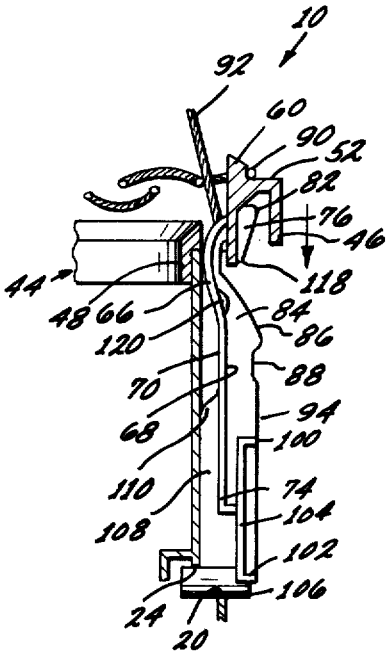

FIG. 7 shows hook 76 passing through loop 90 and FIG. 8 shows needle 10 at its lowermost position where hook 76 is below loop 90.

Figure 9:
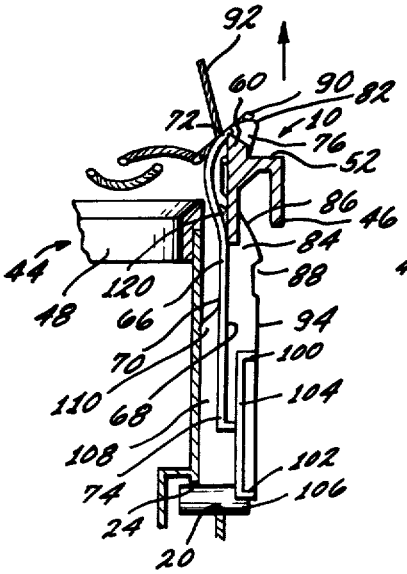
Figure 10:
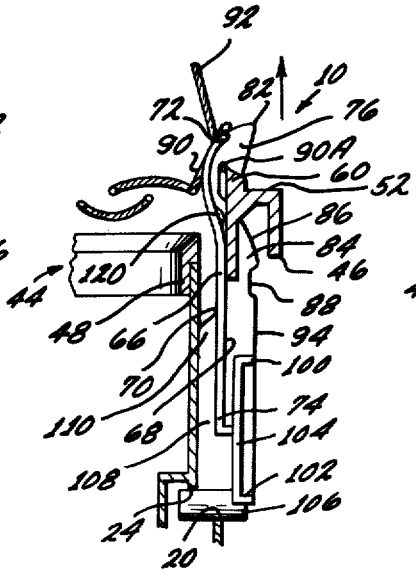
Figure 11:
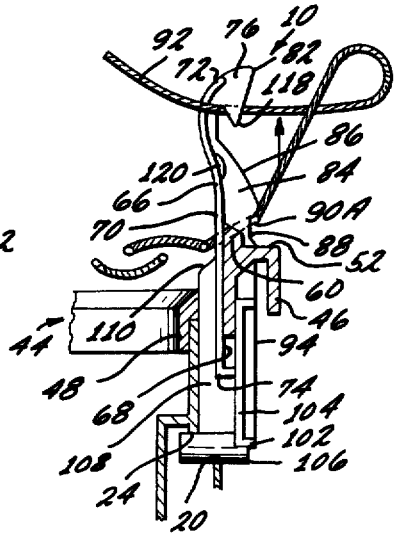

FIG. 9 shows needle 10 starting the up portion of its stroke where nose portion 82 is casting loop 90 off fingers 58, 60. FIG. 10 indicates that a new loop **90*a* is just starting to become disengaged from hook 76 and FIG. 11 shows loop 90*a* after it has moved down ramp 86 to notch 88. Needle 10 is then at the top of the up portion of its stroke ready to engage the next increment of yarn 92.**

While the particular knitting needle herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. In a knitting machine having means for imparting a predetermined stroke to a knitting needle, the improvement comprising:

1. stationary loop-holding means; and 2. a unitary knitting needle including:

A. a hook having an open side and a closed side, said closed side including first means extending upwardly and outwardly past said open side for casting a loop off said stationary loop-holding means during a first increment of said stroke;

B. second means on said needle adjacent said hook for carrying a knitted loop from said hook to said stationary loop-holding means during a second increment of said stroke; and C. third means connecting said needle to said stroke-imparting means in operative association with said stationary loop-holding means, said first and second means being formed integrally with said hook and being immovable with respect thereto.

2. An improvement as stated in claim 1 wherein said knitting needle includes a shank and wherein said second means comprises a notch provided on said shank below said open side.

3. A knitting needle for depositing knitted loops on, and for removing them from, a loop-holding device, comprising:

an elongated shank having a front side, a rear side, an upper end and a lower end;

a hook formed at said upper end, said hook having an open side and a closed side, said closed side including a nose portion extending upwardly and outwardly away from said front side of said shank to a predetermined position;

an elongated web provided on said front side of said shank, said web including a ramp adjacent said open side of said hook and a loop-holding notch between said ramp and said lower end of said shank, whereby a knitted loop of yarn may leave said hook through said open side, move down said ramp and become engaged in said notch during upward movement of said needle, said predetermined position of said nose portion being slightly laterally outwardly beyond said loop-holding device, whereby said nose portion is adapted to move to the outer perimeter of said knitted loop to dislodge it from said loop-holding device when said needle starts a new stroke from its lowermost position after completing a preceding stroke wherein said notch carried said knitted loop to said loop-holding device; and connecting means formed at said lower end of said shank for connecting said needle to a knitting machine for reciprocation thereby.

* * * * *